US008936538B2

(12) United States Patent
Marcantonio

(10) Patent No.: US 8,936,538 B2
(45) Date of Patent: Jan. 20, 2015

(54) EXERCISING APPARATUS

(76) Inventor: Richard Marcantonio, Irvington, NY (US)

( * ) Notice: Subject to any disclaimer, the term of this patent is extended or adjusted under 35 U.S.C. 154(b) by 872 days.

(21) Appl. No.: 13/030,987

(22) Filed: Feb. 18, 2011

(65) Prior Publication Data

US 2011/0143893 A1 Jun. 16, 2011

Related U.S. Application Data

(63) Continuation-in-part of application No. 12/288,493, filed on Oct. 21, 2008, now Pat. No. 7,892,156, which is a continuation-in-part of application No. 11/982,911, filed on Nov. 6, 2007, now Pat. No. 7,530,935.

(60) Provisional application No. 60/878,427, filed on Jan. 3, 2007.

(51) Int. Cl.

| | |
|---|---|
| ***A63B 21/008*** | (2006.01) |
| ***A47K 17/02*** | (2006.01) |
| ***A63B 21/00*** | (2006.01) |
| ***A63B 23/02*** | (2006.01) |
| ***A63B 23/12*** | (2006.01) |
| *A63B 71/00* | (2006.01) |

(52) U.S. Cl.

CPC ..... *A47K 17/02* (2013.01); *A63B 21/1492* (2013.01); *A63B 23/0211* (2013.01); *A63B 23/12* (2013.01); *A63B 21/0083* (2013.01); *A63B 21/0087* (2013.01); *A63B 2071/0018* (2013.01); *A63B 2208/0233* (2013.01); *A63B 2210/02* (2013.01); *Y10S 482/904* (2013.01)

USPC ..... 482/112; 482/904

(58) Field of Classification Search

USPC ..... 482/49, 51, 62, 70, 92–94, 97–103, 482/111–112, 121–124, 127–128, 139, 904

See application file for complete search history.

(56) References Cited

U.S. PATENT DOCUMENTS

| | | | | | |
|---|---|---|---|---|---|
| 2,803,041 | A | * | 8/1957 | Hill et al. | 264/75 |
| 4,911,425 | A | * | 3/1990 | Kynast et al. | 482/54 |
| 4,936,573 | A | * | 6/1990 | Miller | 482/118 |
| 4,961,569 | A | * | 10/1990 | Roberge | 482/62 |
| 5,044,629 | A | * | 9/1991 | Ryan et al. | 482/101 |
| 5,048,827 | A | * | 9/1991 | Caruso | 482/73 |
| 5,071,119 | A | * | 12/1991 | Johnson | 482/112 |
| 5,100,128 | A | * | 3/1992 | Mabry et al. | 482/134 |
| 5,242,179 | A | * | 9/1993 | Beddome et al. | 280/233 |
| 5,372,564 | A | * | 12/1994 | Spirito | 482/112 |
| 5,643,143 | A | * | 7/1997 | Burak et al. | 482/54 |
| 5,697,628 | A | * | 12/1997 | Spear | 280/304.1 |

(Continued)

*Primary Examiner* — Loan H Thanh
*Assistant Examiner* — Jennifer M Deichl
(74) *Attorney, Agent, or Firm* — Karl F. Milde, Jr.; Eckert Seamans Cherin & Mellott, LLC

(57) ABSTRACT

An exercising apparatus designed to fit around a seat includes a frame that is adapted to be secured to a support. The frame is a U-shaped configuration with a lateral open area to receive the seat into the frame. One or more arms are coupled to the frame about one or more pivots. Further, the pivots allow a pivotal motion of each of the arms when a force is exerted thereto by a user. One or more resistance devices coupled to the frame and the arms, which provide resistance to the pivotal motion of each of the arms. The resistance devices, which may be a hydraulic or pneumatic piston and cylinder, may include a spring to bias the arms toward their initial, upright position.

13 Claims, 19 Drawing Sheets

(56) References Cited

U.S. PATENT DOCUMENTS 5,762,593 A * 6/1998 Whiteley ..... 482/134
6,334,624 B1 * 1/2002 Giglio ..... 280/304.1
7,125,365 B2 * 10/2006 Krietzman ..... 482/112
2005/0227824 A1 * 10/2005 Wu et al. ..... 482/62

* cited by examiner

EXERCISING APPARATUS

CROSS-REFERENCE TO RELATED APPLICATIONS

The present application is a continuation-in-part of U.S. patent application Ser. No. 12/288,493, filed Oct. 21, 2008, entitled "Exercising Apparatus," scheduled to issue as U.S. Pat. No. 7,892,156, which in turn is a continuation-in-part of U.S. patent application Ser. No. 11/982,911, filed Nov. 6, 2007, entitled "Exercising Apparatus," now U.S. Pat. No. 7,530,935, which is based upon and claims priority from U.S. Provisional Application No. 60/878,427, filed Jan. 3, 2007, entitled "Exercise Apparatus."

BACKGROUND OF THE INVENTION

The present invention relates, in general, to an exercising apparatus. More specifically, the present invention relates to an exercising apparatus designed to fit around a seat, such as a toilet seat or a wheelchair.

Various types of exercising apparatus are known in the art that are intended for indoor use. Typically, an exercising apparatus includes a frame standing on a floor on which resistance delivery systems are attached and the resistance delivery systems provide resistance to a force applied by a user. Further, the frame has a seat or a bench attached to it on which the user may sit or lay down depending upon the exercise to be performed.

Conventional exercising apparatus with an attached seat is suitable to use for the intended exercise; however, such an exercising apparatus occupies a relatively large space. Moreover, a separate room or a large area is required for the exercising apparatus. Further, such exercising apparatus does not have provision for a user in a wheelchair or on a toilet seat to exercise without getting up out of the seat.

In light of the foregoing, there is a need for an exercising apparatus that is easy to fit around an existing seat.

SUMMARY OF THE INVENTION

An object of the present invention is to provide an exercising apparatus that is designed to fit around a seat.

Another object of the present invention is to provide an exercising apparatus that is designed to fit around a toilet seat.

Another object of the present invention is to provide an exercising apparatus that is designed to receive a wheelchair.

Embodiments of the present invention provide an exercising apparatus designed to fit around a seat. In one configuration of the apparatus, the seat is a toilet seat. The exercising apparatus includes a frame adapted to be attached to a support through one or more attachment devices. The support may be a wall or a base member or the seat. One or more arms are pivotally coupled to the frame through one or more pivot joints. The pivots allow a pivotal motion of each of the arms when a user exerts a directional force on the arms. The user may sit on the seat and exert the directional force on the arms.

One or more first resistance devices are attached to the frame and the arms. The first resistance devices provide resistance to the pivotal motion. The resistance may be increased or decreased based on the convenience of the user. The exercising apparatus includes one or more handgrip members that are releasably attached to each of the arms. One or more shafts protrude from the arms and are attached to the handgrip members. These shafts extend or retract based on a linear axial movement of the shafts with respect to the arms. The linear axial movement of the shafts provides proper hand positioning of the user during exercise. In addition, the exercising apparatus includes one or more second resistance devices inside the arms, which are attached to the shafts. These second resistance devices provide resistance to the linear axial movement.

In another configuration, the exercising apparatus is designed to receive a wheelchair. This exercising apparatus includes a frame with a U-shaped configuration and a lateral open area to receive the wheelchair into the frame. The frame is mounted on a base and attached to a support. In a particular embodiment, the frame is secured to the base through a base plate. In this embodiment, the base plate receives the wheelchair and is secured in place on the base by the weight of the user.

The present invention concerns various aspects of an exercising apparatus of the aforementioned type. In a first aspect of the invention, means are provided to adjust the resistance applied to the arms, against the directional force applied by the user. As will be explained in detail below, the resistance is adjusted by adjusting the position of a "control point"; that is, the point at which a resistance device is coupled to the arm. This adjustment, which can be easily made by the user by turning a knob, changes the distance of the control point from the pivot point of the arm, thus changing the mechanical advantage of the resistance device.

Another aspect of the invention relates to a locking mechanism for adjustably limiting the range of motion of the arm about their pivot points. In this way, the range of motion can be adjusted to fit the needs of the user, so that the user need not stretch beyond a comfortable limit when exercising with the arms. The locking mechanism may be operated to constrain only one end of the range of motion of an arm about its pivot, or constrain both ends of the range of motion. In a particular embodiment, where the resistance device comprises a hydraulic or pneumatic cylinder with an internal piston, the locking mechanism includes a device, attached to the cylinder, for limiting the motion of the piston within the cylinder.

According to another aspect of the invention, each arm of the exercise device is provided at its end with a handgrip member to be gripped by a user which is moveable to, and lockable at, at least two different positions with respect to the arm. For example, the handgrip member may be rotated about the longitudinal axis of the arm to its most convenient angular position for the user. In a preferred embodiment, the handgrip member may be rotated to a first position directed toward the user or to a second position directed away from the user.

The mechanism for locking and retaining the handgrip member includes two tubes, arranged coaxially and surrounding with the arm and the stem of the handgrip member, respectively, which tubes have mating services for engaging one another and limiting their respective movement.

Still another aspect of the present invention relates to the pivot joint used for each arm of the exercise machine. This pivot joint comprises a casing having a first opening accepting a tubular portion of the arm and a second opening accepting a tubular portion of the frame. An internal rotatable joint is provided between the two portions. This joint has an axle aligned with and extending between the tubular portions of the arm and frame, without intersecting either portion.

In another aspect of the invention, an exercising apparatus designed to fit around a seat, comprises, in combination:

a frame adapted to fit around said seat;

an elongate arm pivotally coupled to said frame at a pivot point, said arm being movable about the pivot point in pivotal motion between a first position to a second position based on a force exerted by a user; and a first resistance device, coupled to said frame and to said arm, which provides a resistance force against said pivotal motion of said arm by the user in at least one direction, said elongate arm being longitudinally extendible and retractable in longitudinal motion between a retracted length and an extended length, and having a second resistance device coupled thereto, which provides a resistance force against said longitudinal motion of said arm by the user in at least one longitudinal direction.

In another aspect of the invention, the second resistance device provides a resistance force against the longitudinal motion in both longitudinal directions. The second resistance device may be a hydraulic piston and cylinder, and it may be disposed inside of the arm.

In another aspect of the invention, the arm comprises a first tube having a first width and a second tube having a second width which is less than the first width. The second tube is disposed, in part, inside the first tube, with one of the first and second tubes forming a first end and the other of the first and second tubes forming a second end of the arm. The first and second tubes are movable with respect to each other in the longitudinal direction.

In another aspect of the invention, the arm is coupled to the frame at the pivot point at the first end. The arm may comprise a user handle at the second end.

In another aspect of the invention, the second resistance device is disposed inside of the second tube.

In another aspect of the invention, the second resistance device is a hydraulic piston and cylinder having two ends.

In another aspect of the invention, the arm further comprises a bushing disposed between said first tube and said second tube and affixed to said first tube. One end of the second resistance device is coupled to the frame at said pivot point, and an opposite end of the second resistance device is coupled to the bushing.

In another aspect of the invention, the second tube has at least one longitudinal slot. The arm further comprises a pin which extends through the bushing and the longitudinal slot or slots.

In another aspect of the invention, an exercising apparatus designed to fit around a seat, comprises, in combination:

(a) a frame adapted to fit around the seat;

(b) an elongate arm pivotally coupled to the frame at a pivot point, the arm being movable about the pivot point in pivotal motion between a first position to a second position based on a force exerted by a user, the arm being coupled to the frame at the pivot point at a first end and having a an opposite second end;

(c) a first resistance device, coupled to the frame and to the arm, which provides a resistance force against the pivotal motion of the arm by the user in at least one direction; and (d) an elongate user handle pivotally coupled to the arm at the second end, the arm having means for clamping the handle in a desired fixed position, wherein the handle pivots about a pivot axis which extends perpendicular to a longitudinal axis of the arm.

In another aspect of the invention, the arm pivots about a substantially horizontal pivot axis with respect to the frame.

In another aspect of the invention, the pivot axis of the handle is perpendicular to the pivot axis of the arm.

In another aspect of the invention, the handle extends into a first opening at said second end of the arm. The means for clamping the handle in a desired fixed position includes a lock knob at the second end which also extends into the first opening.

In another aspect of the invention, the lock knob extends through a second opening in the arm which extends perpendicular to the first opening.

In another aspect of the invention, the lock knob and the second opening are in screw threaded relationship.

In another aspect of the invention, the second opening in the arm extends along a longitudinal axis of the arm and the lock knob is disposed on the arm at the second end.

In another aspect of the invention, the elongate handle and the means for clamping the handle in position are operative to clamp the handle in at least two positions such that a longitudinal axis of the handle is perpendicular to the longitudinal axis of the arm.

In another aspect of the invention, the elongate handle and the means for clamping the handle in position are operative to clamp the handle in at least four positions such that a longitudinal axis of the handle is either parallel or perpendicular to the longitudinal axis of the arm.

For a full understanding of the present invention, reference should now be made to the following detailed description of the preferred embodiments of the invention as illustrated in the accompanying drawings.

Figure 1:
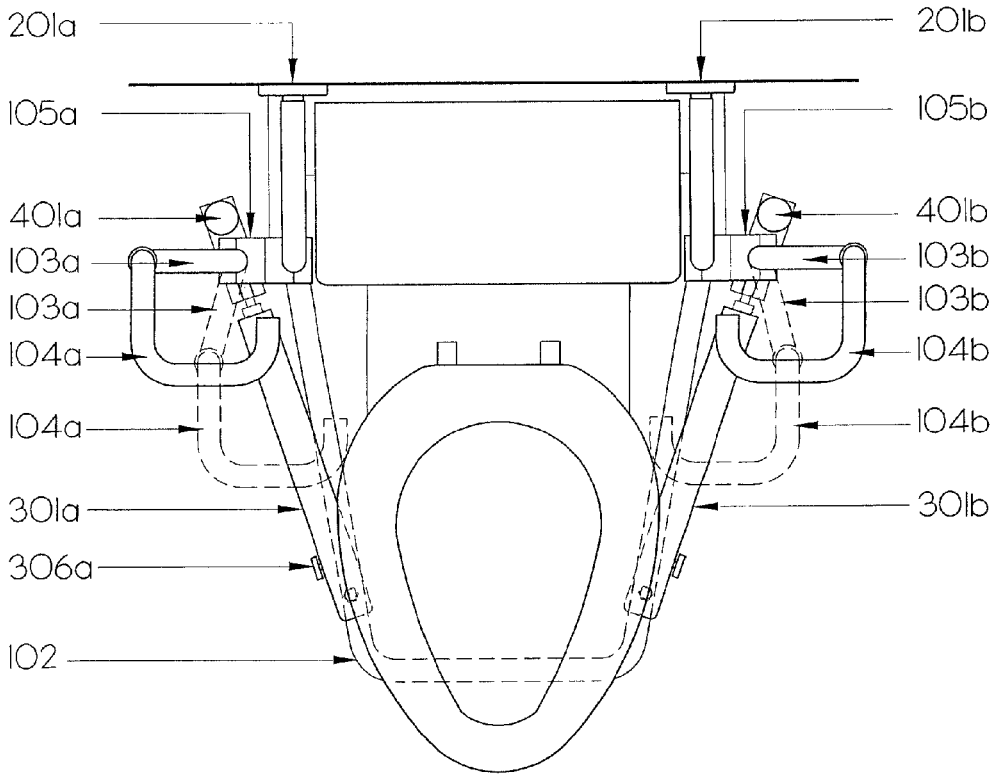
FIG. 1 is a top, plan view of the exercise machine according to the invention, in a configuration designed to fit around a toilet seat.

For a full understanding of the present invention, reference should now be made to the following detailed description of the preferred embodiments of the invention as illustrated in the accompanying drawings.

DETAILED DESCRIPTION OF THE PREFERRED EMBODIMENTS

In the description herein for embodiments of the present invention, numerous specific details are provided, such as examples of components and/or mechanisms, to provide a thorough understanding of embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Embodiments of the present invention relate to an exercising apparatus designed to fit around a seat. Various embodiments of the invention provide an exercising apparatus that includes a frame, one or more arms and one or more resistance devices. The frame is secured to a support. The frame has a U-shaped configuration to receive a seat into the frame. The arms are pivotally coupled to the frame at one or more pivots. A pivotal motion is provided to each of the arms about the pivots with the frame, when a user exerts a directional force on the arms. The resistance devices are coupled to the frame and the arms and provide resistance to the pivotal motion. Retraction devices return the arms to their initial positions after they have been moved by the user.

Reference will now be made in detail to several embodiments of the invention that are illustrated in the accompanying drawings. Wherever feasible and convenient, same reference numerals are used in the figures and the description to refer to the same or like parts. The drawings are in a simplified form and not to scale. For purposes of convenience and clarity only, directional terms, such as top, bottom, left, right, up, down, over, above, below, beneath, rear, and front may be used with respect to the drawings. These and similar directional terms should not be strictly construed to limit the scope of the invention. In addition, words such as couple, connect, and similar terms with their inflectional morphemes are used interchangeably, unless the difference is noted or made otherwise clear from the context. These words and expressions do not necessarily signify direct connections, but include connections through mediate components and devices.

Figure 2:
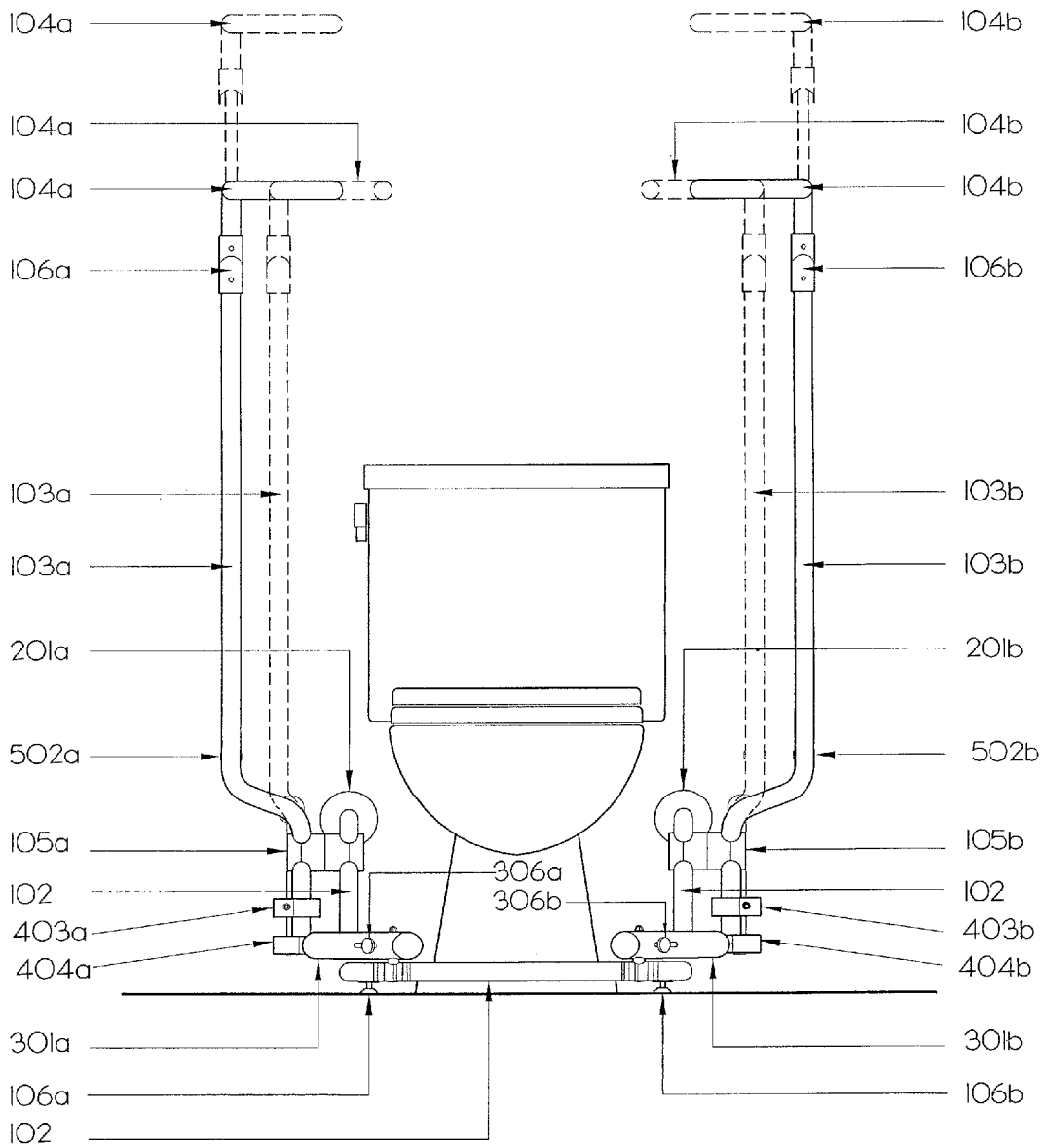
FIG. 2 is a front view of the exercise apparatus of FIG. 1.
Figure 3:
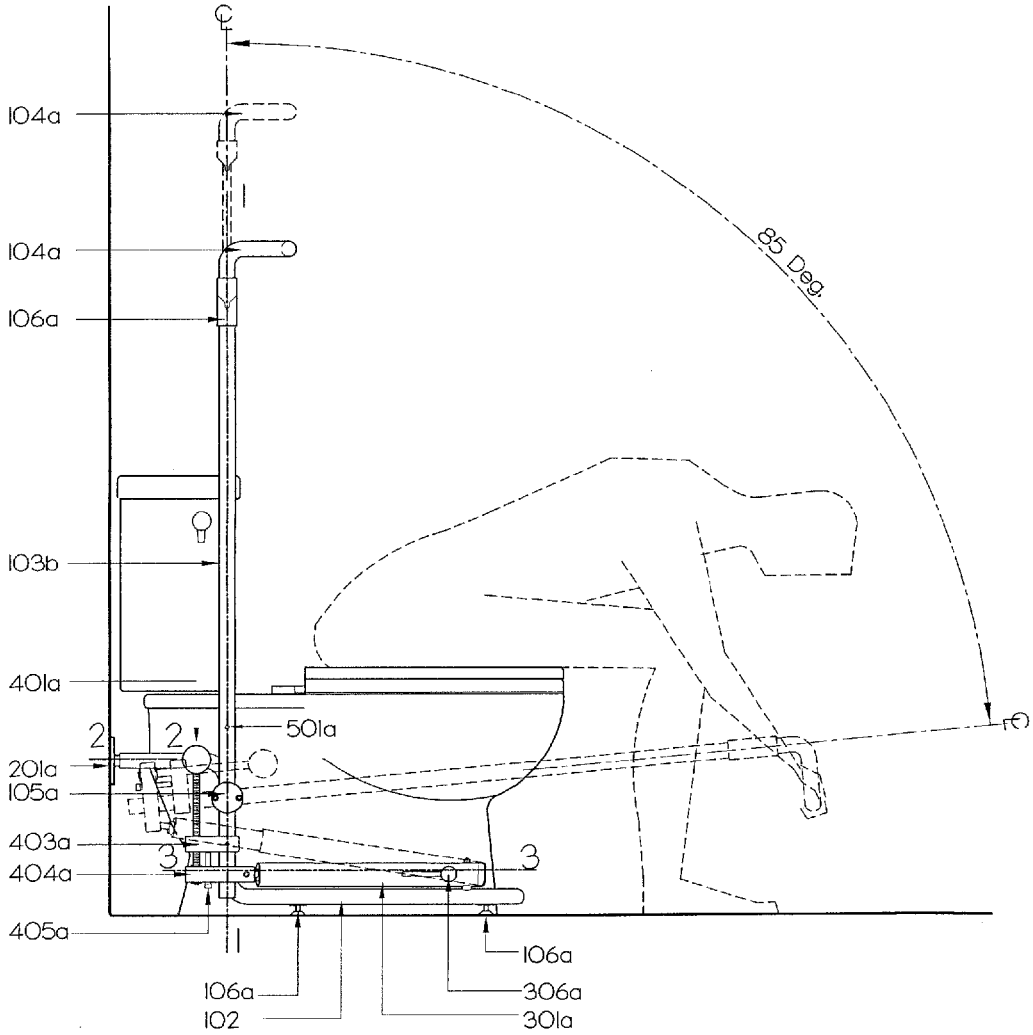
FIG. 3 is a side view of the exercise apparatus of FIG. 1.
Figure 4:
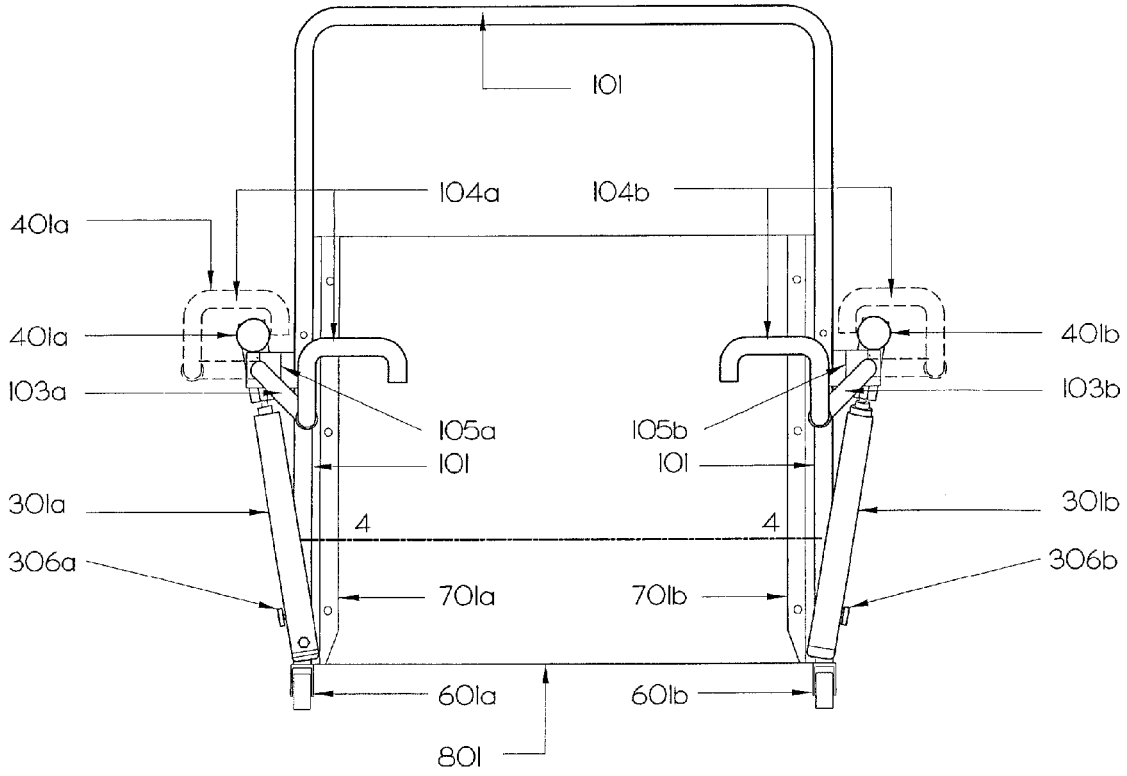
FIG. 4 is a top plan view of exercise apparatus in a configuration design to fit around a wheelchair.
Figure 5:
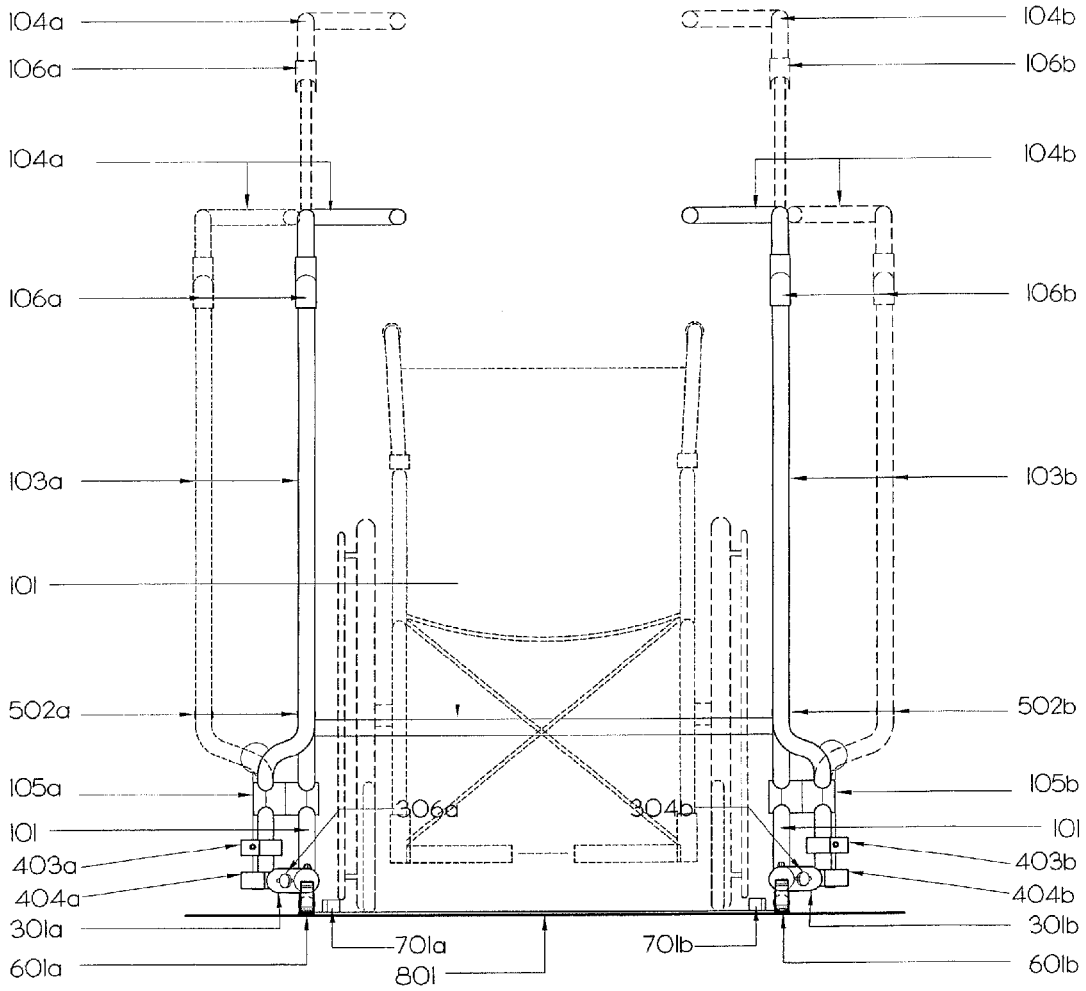
FIG. 5 is a front view of the exercise apparatus of FIG. 4.

FIGS. 1-3 illustrate the configuration of the exercise apparatus designed to fit around a toilet seat and be operated by a user while sitting on this seat. FIGS. 4-8 show the configuration of the exercise apparatus designed to be operated by a person while sitting in a wheelchair. The two configurations are similar in many respects and, in particular, they are similar with respect to the aspects, features and mechanisms to which the present invention relates.

Figure 10:
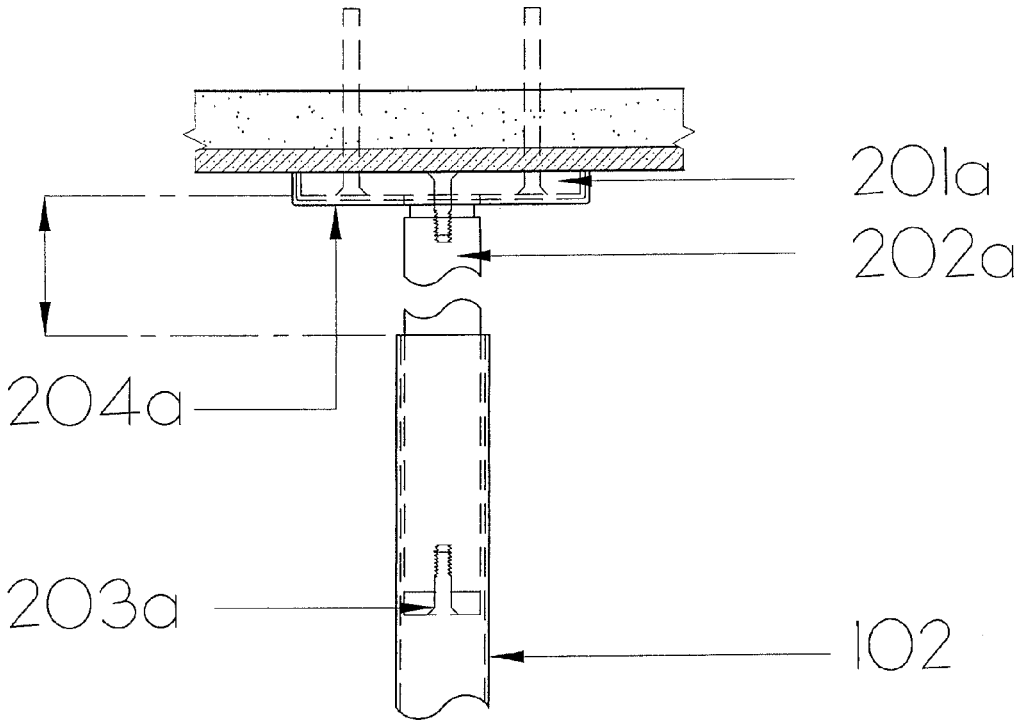
FIG. 10 is a detailed view showing how the exercise apparatus of FIG. 1 may be adjustably mounted to a wall behind a toilet seat.

Generally, the first configuration shown in FIGS. 1-3 comprises a frame 102 adapted to surround a toilet and be attached to a wall by brackets 201*a* and 201*b* directly behind the toilet. The brackets can be adjustable, for example, in the manner shown in FIG. 10. In this arrangement, a tubular member 202*a* is fitted within the frame tube 102 and is adjustably fixed therein by an expansion joint 203*a*. The opposite end of the tube 202*a* is attached to the bracket 204*a* which, in turn, is attached to the wall.

Returning to FIGS. 1-3, it may be seen that the exercise apparatus comprises arms 103*a* and 103*b* which are pivoted with respect to a tubular portion of the frame 102 by pivot joints 105*a* and 105*b*, respectively. The structure of each pivot joint will be described below in connection with FIG. 9.

The spacing between the arms 103*a* and 103*b* may be adjusted by loosening screws 109*a* in the pivot joint and rotating the arms about their axis which passes through the pivot joints and then retightening the screws.

Handgrip members 104*a* and 104*b* are provided and, as shown in FIG. 2, can be extended upward or downward with respect to the arms 103*a* and 103*b*, respectively, in which they are coaxially inserted. This extension affords an additional mode of exercise for the user. As will be described below in connection with FIG. 9, a resistance device is provided within each arm to act against the force applied by the user to extend or retract the handgrip member.

In addition, it may be seen that the handgrip members 104*a* and 104*b* may be rotated in position either toward or away from the user. When the handgrip members are in their retracted position, as shown by solid lines in FIG. 2, they are prevented from rotating about the longitudinal axis of the arm by interlocked mating portions of the tube sections 106*a* and 106*b*.

FIG. 3 shows a piston and cylinder device 301*a* which provides resistance to the force applied by the user to the arm 103*a*. This resistance device is attached at one end to a tubular portion of the frame 102 and is attached at the opposite end to a mechanism for adjusting the distance from a control point to the pivot joint 105*a* of the arm 103*a*. The mechanism, comprising elements 401*a*, 403*a*, 404*a* and 405*a* will be described below in connection with FIG. 12.

The movement of the arm 103*a* about the pivot joint 105*a* is limited by the path of travel of the piston within the cylinder 301*a*. This path of travel, which is shown in FIG. 3 as an 85° arc from the vertical to the forward position, may be adjusted and limited by adjusting the position of a thumbscrew 306*a*. This mechanism for adjusting the limit of travel of the arm will be described in detail below in connection with FIGS. 13 and 14. Suffice it to say, at this point, that the arc of movement of the arm is limited by the piston and cylinder at both ends of its travel: from the vertical to a position away from the vertical that is selectable by the user.

Figure 6:
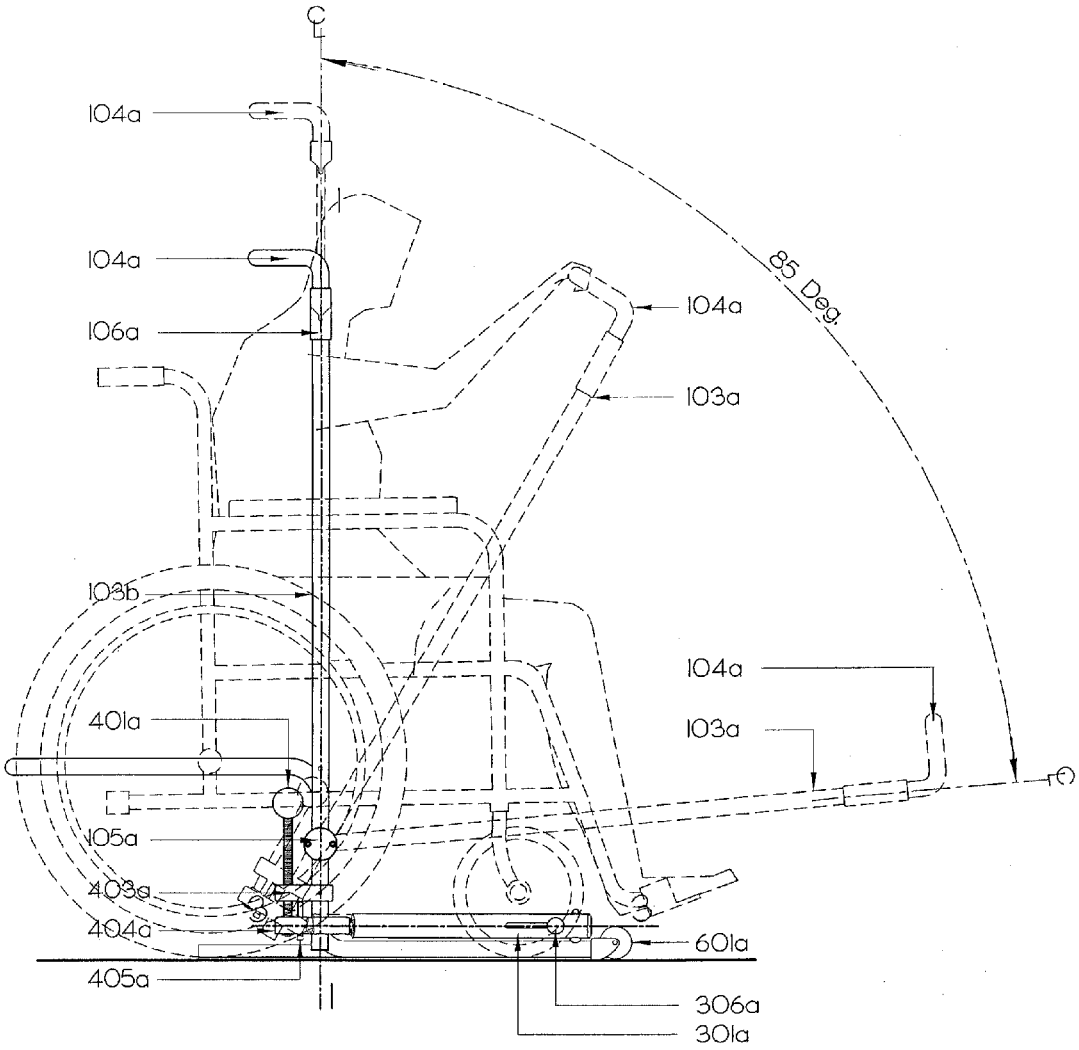
FIG. 6 is a side view of the exercise apparatus of FIG. 4.
Figure 7:
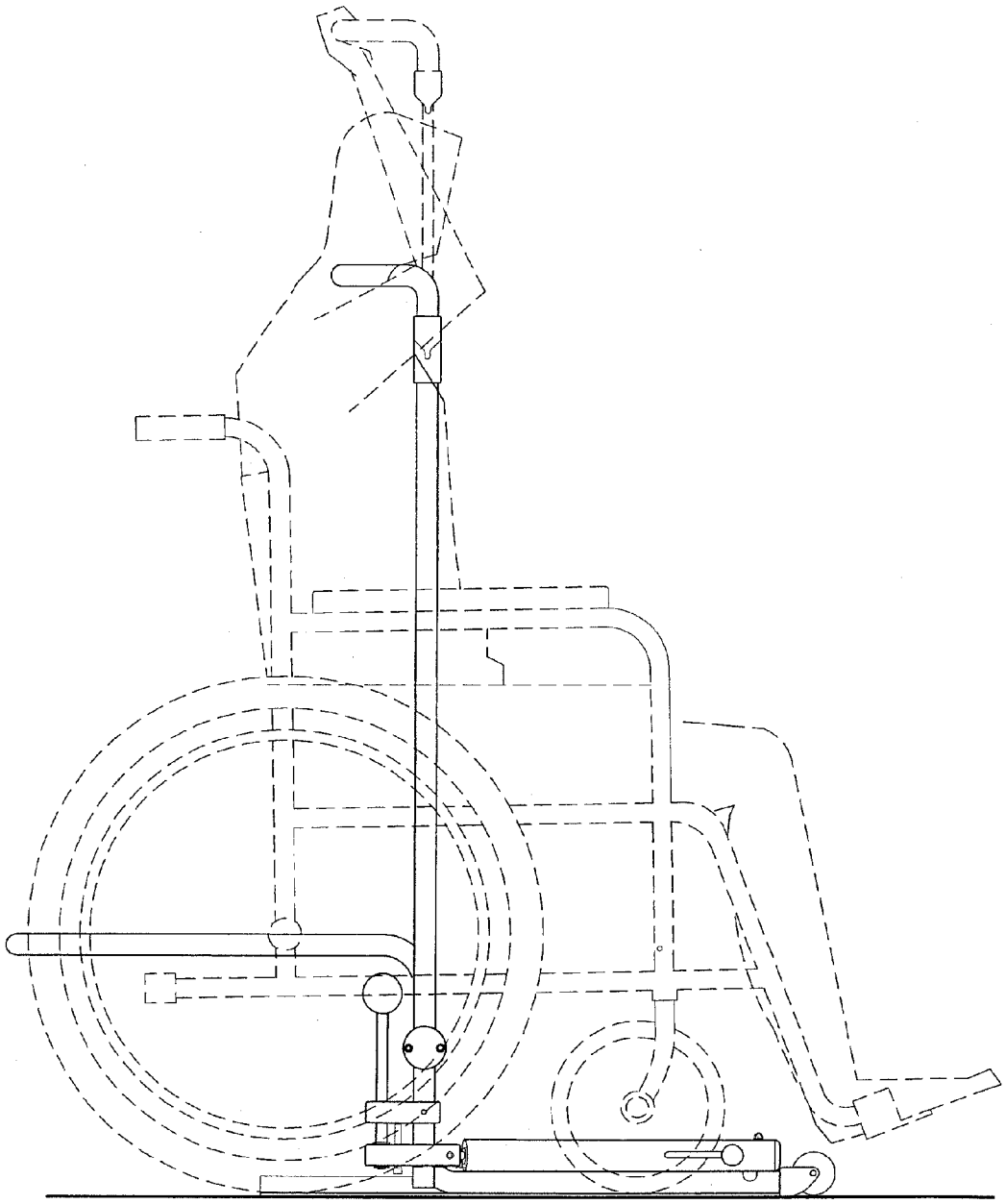
FIG. 7 is another side view of the exercise apparatus of FIG. 4, with the user in a first position.
Figure 8:
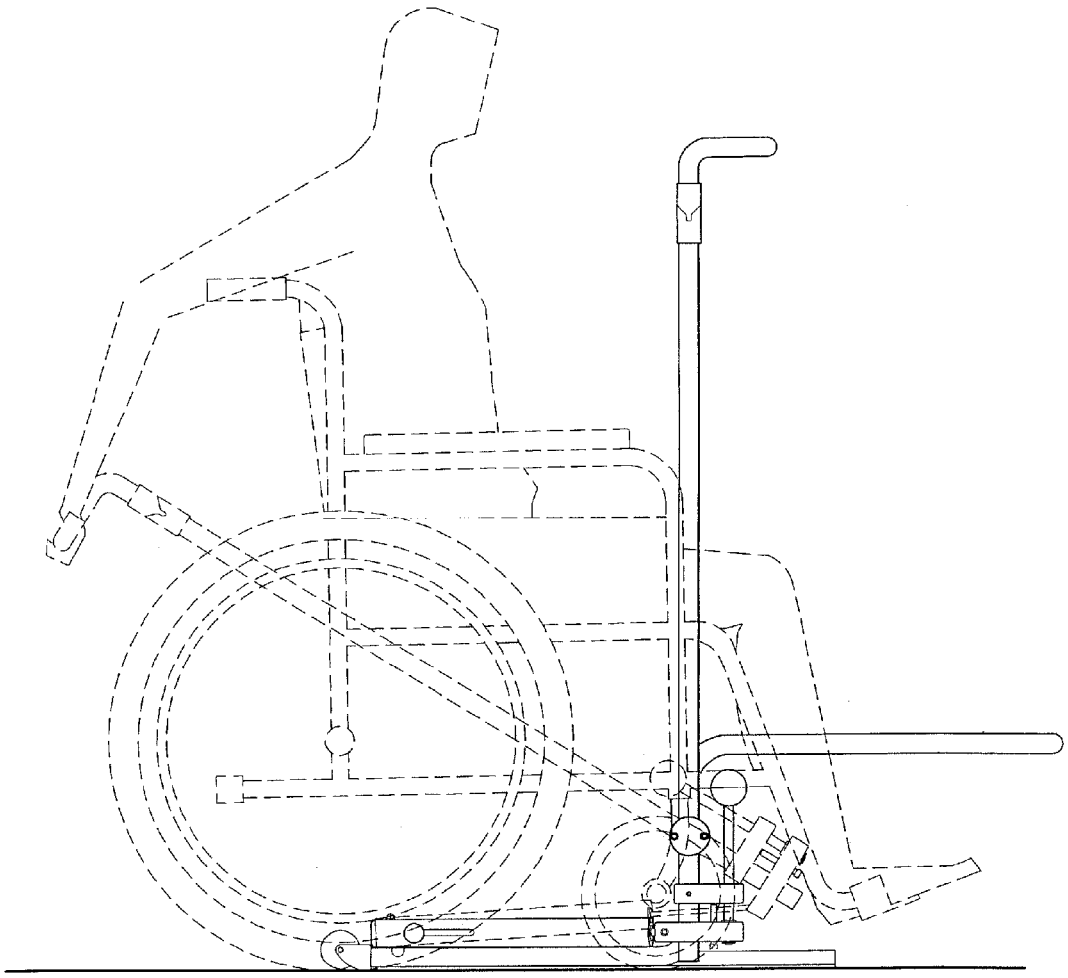
FIG. 8 is another side view of the exercise apparatus of FIG. 4, with the user in a second position, opposite in direction to the first position.

FIG. 7 shows how a user, who in this case sits in a wheelchair, may exercise by moving the arms up and down. FIG. 6 shows how the user may exercise by moving the arm 103*a* forward. FIG. 8 shows how a user may operate the exercise device with the direction of the wheelchair reversed within the apparatus.

Figure 9A:
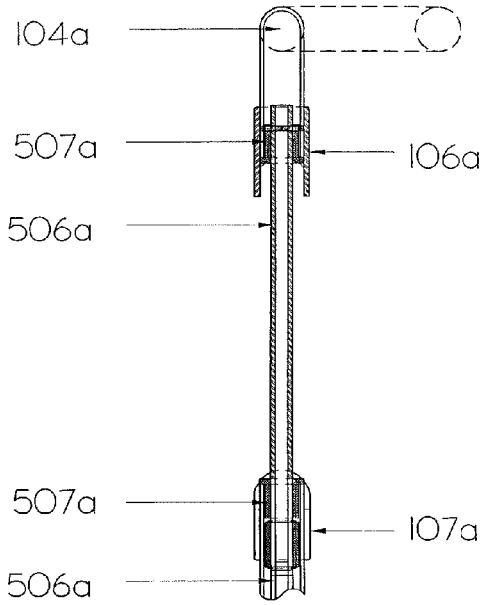
FIG. 9*a* is a detailed view of the handgrip member and its attached stem in an upwardly extended position with respect to the arm of the exercise apparatus.
Figure 9:
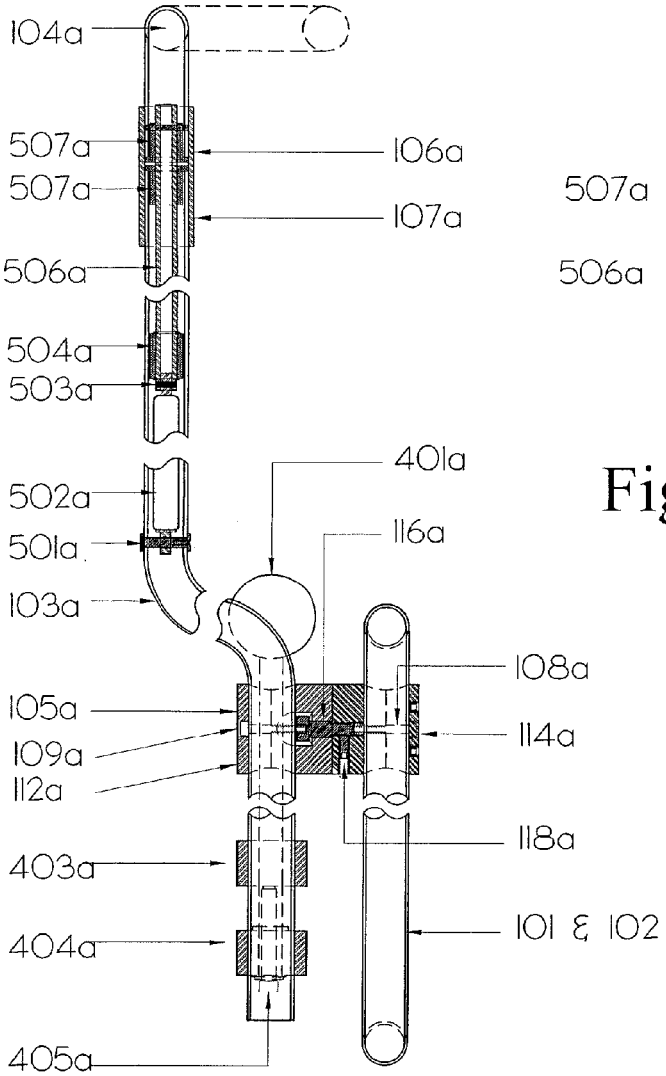
FIG. 9 is a detailed and cross-sectional view showing the pivot joint between and arm and the frame of the exercise apparatus and showing the mechanism for moving the handgrip member axially with respect to the arm to provide an additional mode of exercising.

FIGS. 9 and 9*a* illustrate with arrangement which enables the handgrip member 104*a* to move axially upward and downward (or outward and inward) with respect to the arm 103*a*. As is shown here, the downwardly extending portion of the handgrip 104*a* is connected by a sleeve 507*a* to a co-axial stem 506*a* which slides within the tube of the arm 103*a*. The stem 506*a* is maintained in alignment with the arm tube 103*a* by a Teflon coated piston 504*a* which slides within the tube 103*a*. A piston/cylinder arrangement 502*a* is connected between the arm 103*a* and the stem 506*a* of the handgrip member 104*a* by means of coupling devices 501*a* and 503*a*, respectively.

FIG. 9 also shows the structure of the pivot joint 105*a*. As is illustrated there, the pivot joint comprises a casing 105*a* having first and second openings, accommodating the tubular portions of the arm 103*a* and the frame 102, respectively. These tubular portions are held in place by set screws 108*a* and 109*a* which clamp the casing tightly about the arm and frame, respectively.

The two portions of the casing 112*a* and 114*a* are rotatable with respect to each other about a central axle formed by a screw 116*a*, fixed in position by the set screw 118*a*.

Figure 11:
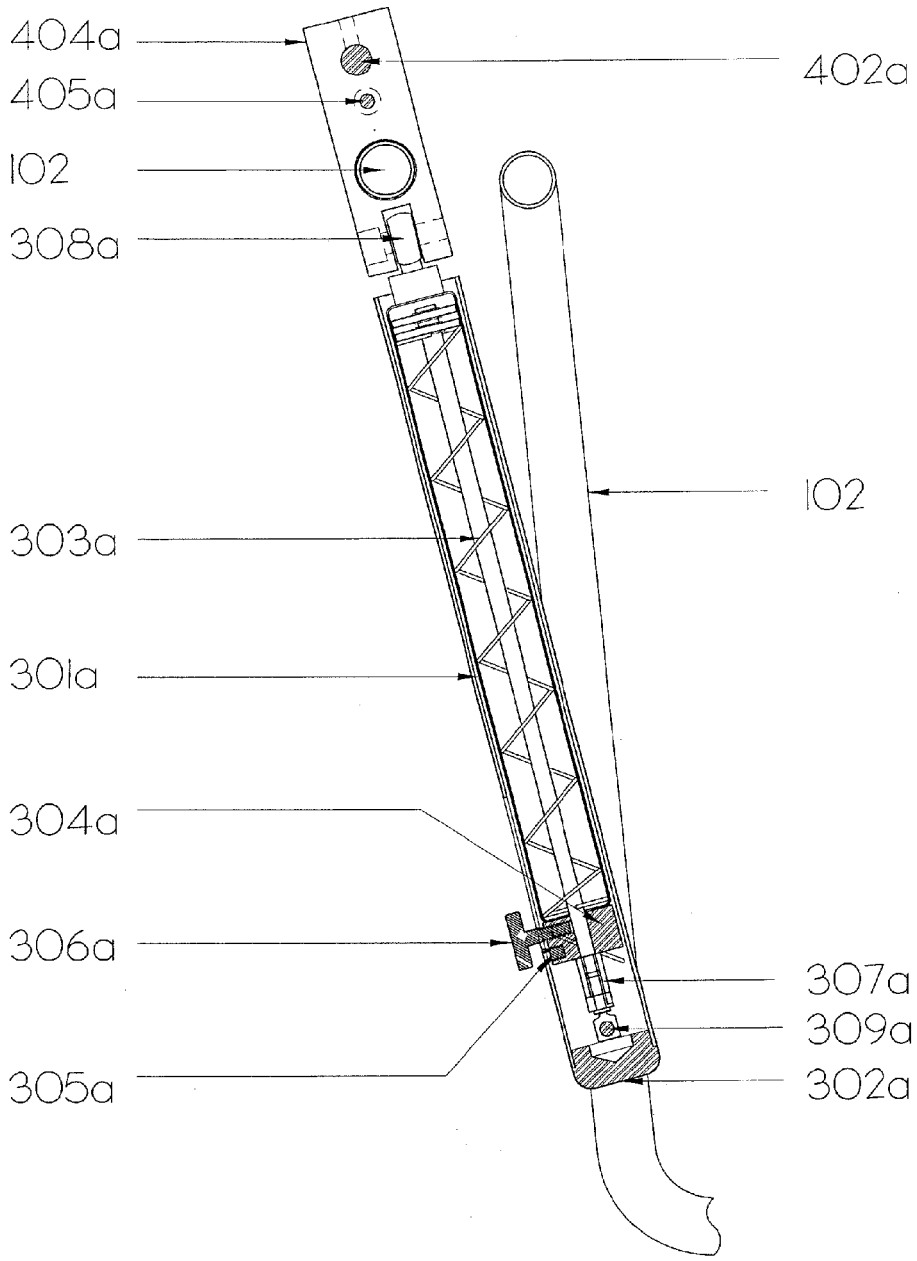
FIG. 11 is a detailed and cross-sectional view showing the resistance and retraction device for the embodiments of FIG. 1 and FIG. 4, respectively.

FIG. 11 shows the arrangement of a piston and cylinder 301*a* with an internal spring 303*a* which serves as the combined resistance and retraction device of the exercise apparatus. This device 301*a* is pivotally attached to the frame at one end 309*a* and pivotally attached to a resistance force adjusting device at its opposite end 308*a*. The oil within the cylinder flows freely past the piston when the piston travels on one direction (the retraction direction) but is partially blocked when the piston travels in the opposite direction (the resistance direction).

Motion of the piston is limited at the end of its travel within the cylinder by a locking screw 306*a*, which may be adjusted in position at the frame-connected end of the cylinder.

Figure 12:
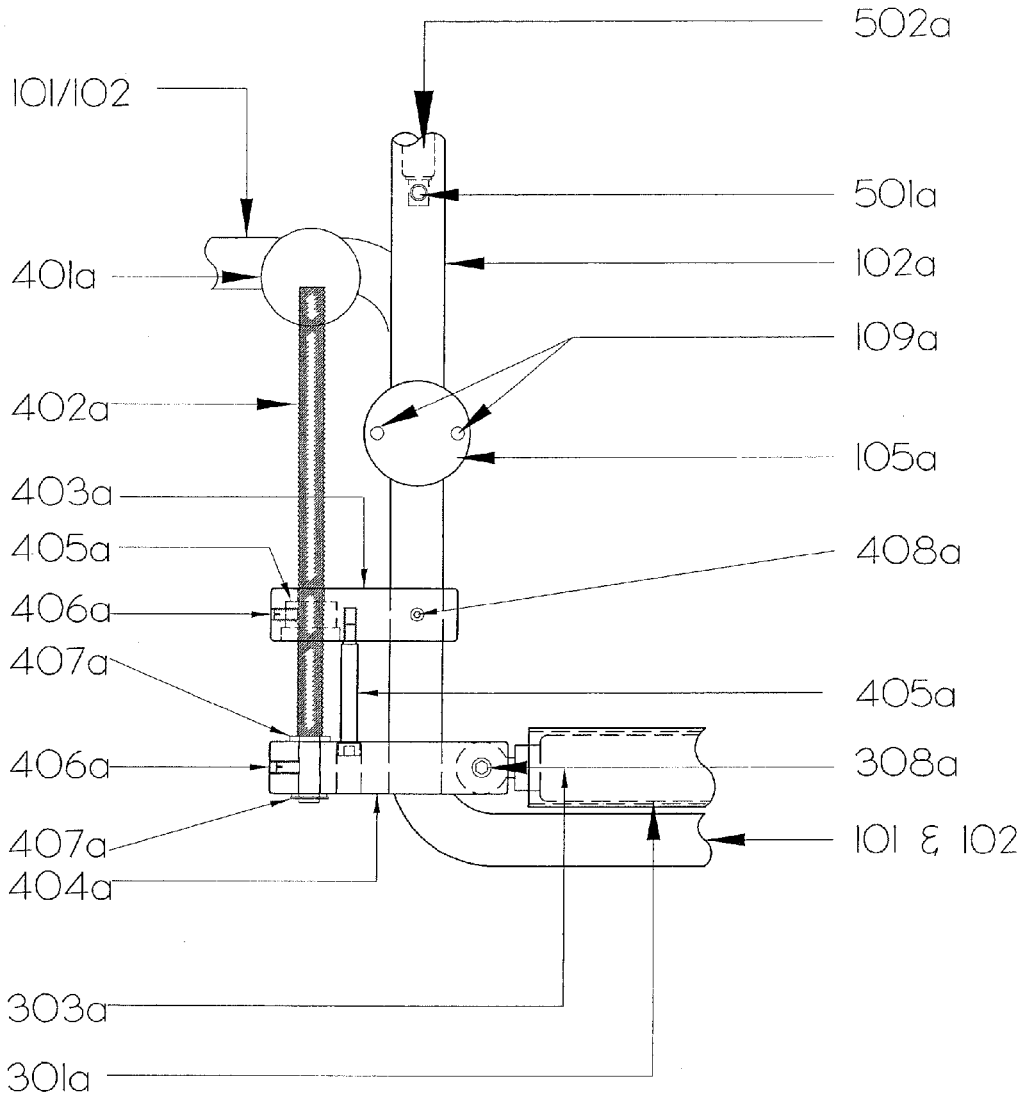
FIG. 12 is detailed view showing the mechanism for adjusting the resistance and retraction forces applied to an arm against the directional force applied by the user.

FIG. 12 shows the mechanism for adjusting the leverage of the piston and cylinder 301*a* that provides both the resistance force and retraction force applied to the arm 102*a*. This mechanism comprises two parallel bars 403*a* and 404*a* which are pivoted with respect to the arm 102*a* and the cylinder 301*a* at points 408*a* and 308*a*, respectively. The bars are maintained in parallel relationship by a pin 405*a* and a threaded bolt 402*a* having a knob 401*a* at the top. The pin 405*a* is rigidly connected to the upper bar 403*a* but slides in an opening within the lower bar 404*a*. The bolt 402*a* has a mating screw thread with the upper bar 405*a*, and is rotatably retained by flanges 407*a* in an opening in the lower bar 404*a*. When the knob 401*a* is rotated, turning the bolt 402*a*, the distance between the upper and lower bars is either increased or reduced, depending upon the direction of rotation. Since the upper bar is fixed with respect to the arm at the pivot point 408*a*, such knob rotation changes the distance of the lower bar 404*a* from the pivot joint 105*a*, thus changing the length of the lever arm of the piston/cylinder 301*a*.

Figure 13:
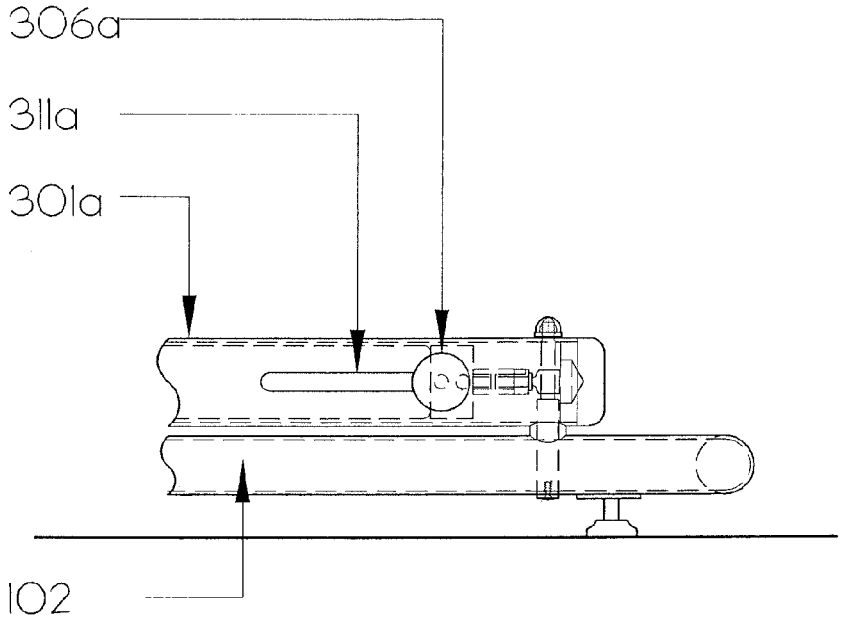
FIGS. 13 and 14 are detailed views showing a locking mechanism for limiting the range of motion of an arm of the exercise apparatus of FIGS. 1 and 4.
Figure 14:
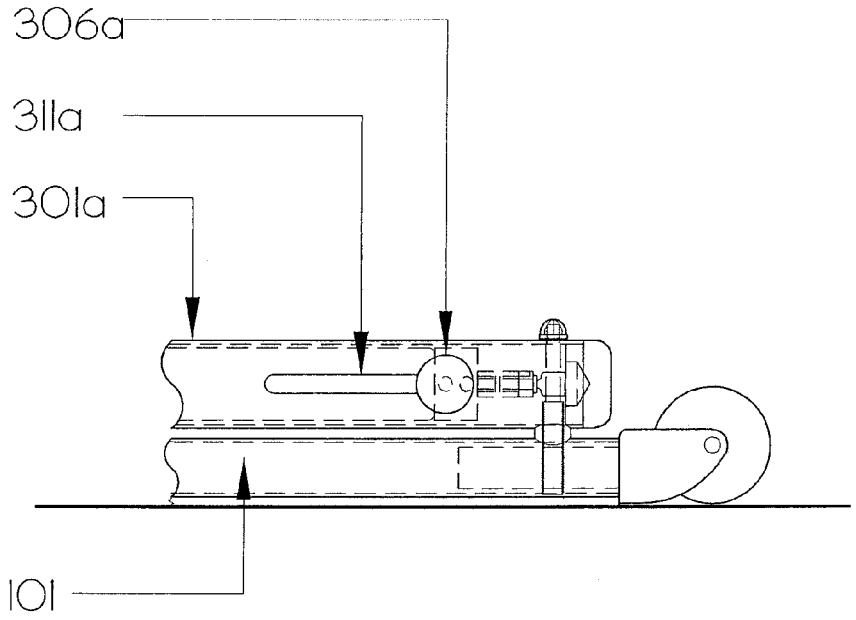

FIGS. 13 and 14 show in detail the locking mechanism for limiting range of arm movement in the first embodiment (FIG. 13) and second embodiment (FIG. 14), respectively. As explained previously in connection with FIG. 11, the locking screw 306*a* may be moved either to the right or to the left along a slot 311*a* and set to limit the end travel of the piston, thus limiting the end travel of the arm 103*a*.

Figure 15A:
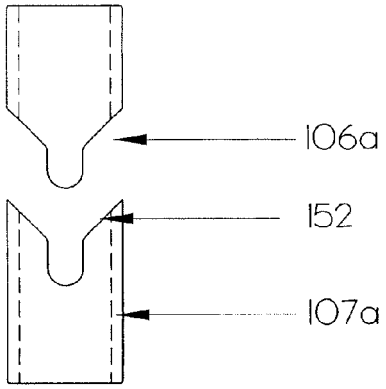
FIGS. 15*a* and 15*b* are side and front views, respectively, of two tubular members for locking the handgrip member in one of two angular positions with respect to the arm to which it is attached.
Figure 15B:
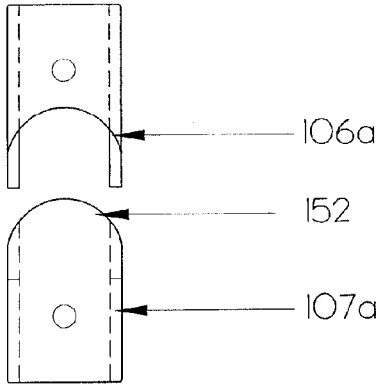
Figure 15C:
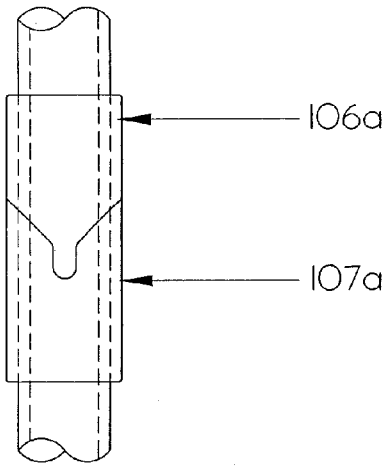
FIGS. 15*c* and 15*d* are side and front views, respectively, of the handgrip position lock with the two tubular members in mating position.
Figure 15D:
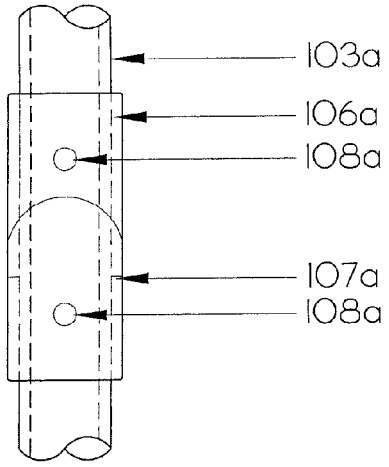

Finally, FIGS. 15*a*-15*d* show the mating surfaces of the upper and lower tubes 106*a* and 107*a*, respectively, which constrain the angular position of the handgrip member. FIGS. 15*a* and 15*b* show the parts as separate, whereas FIGS. 15*c* and 15*d* show the parts in mating relationship. As indicated in FIG. 15*d*, the tubes are fastened to the arm and handgrip member, respectively, by pins 108*a*.

Figure 15E:
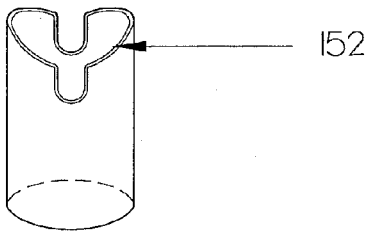
FIG. 15*e* is an isometric view of the lower tubular member shown in FIGS. 15*a*-15*d*.

FIG. 15*e* shows the lower tube 107*a* in isometric view, making visible the mating surface 152 (also identified in FIGS. 15*a* and 15*b*, respectively). The mating surface 152 of the tube member 107*a* has a vertical slot which prevents the handgrip member from rotating when the upper tube member 106*a* is in mating relationship with this lower tube member. This constrains the handgrip member to be either in one of two angular positions which are separated by 180° with respect to each other.

Figure 16:
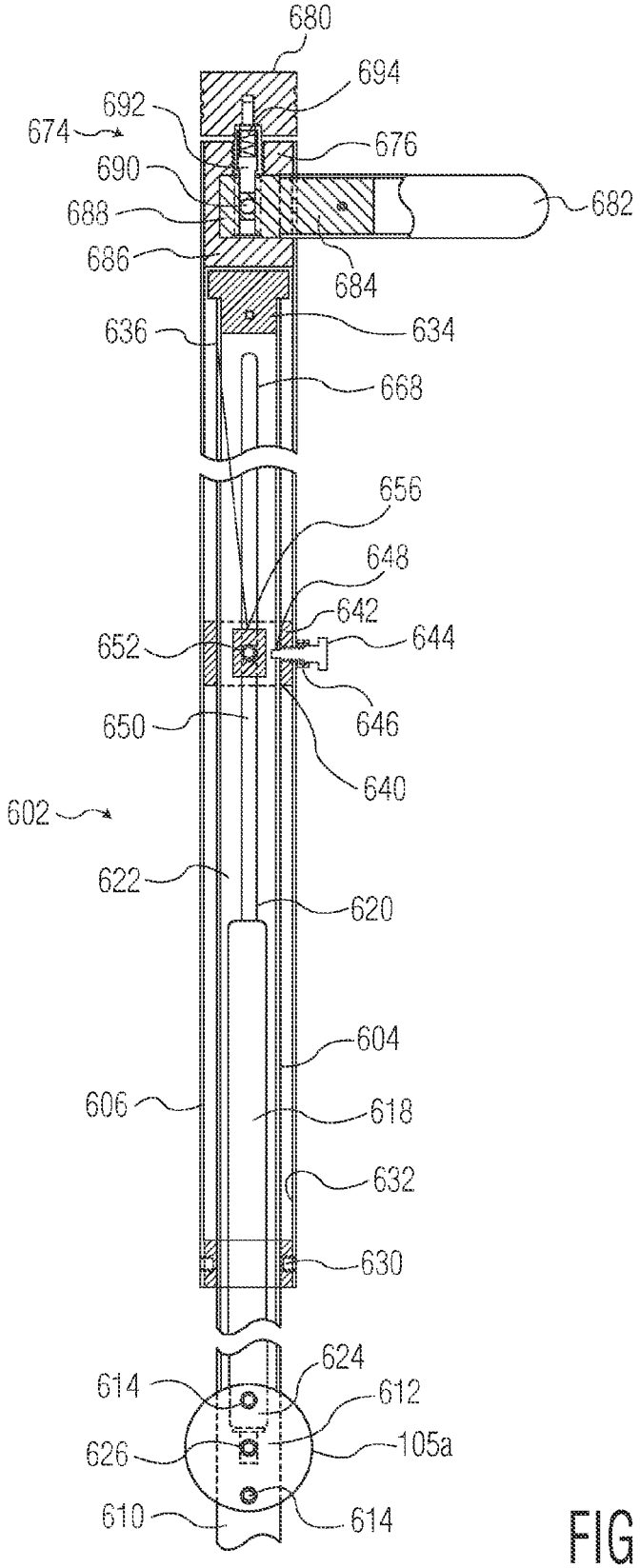
FIG. 16 is a partially cross-sectional view of the arm of another embodiment of an exercise device according to the invention.

In the aspect of the invention set forth in FIG. 16, an arm 602 comprises an inner tubular member 604 slidably positioned within an outer tubular member 606. A proximal end 610 of tubular member 604 extends through a cylindrical opening 612 in pivot joint 105*a*, and proximal end 610 is secured within opening 612 by connectors or bolts 614.

A hydraulic cylinder 616 comprising a cylinder chamber 618 and a cylinder shaft 620 extend through a lumen 622 of inner tubular member 604. A proximal end 624 of cylinder chamber 618 is secured by a connector or bolt 626 to tubular proximal end 610.

Outer tubular member 606 slides over inner tubular member 604. Two bushings, a bushing 630 attached to the inner surface 632 of outer tubular member 606 and a bushing 634 attached to the distal end 636 of inner tubular member 604, keep tubular members 604 and 606 properly spaced apart and facilitate their movement relative to each other. Preferably each bushing 630 and 634 is comprised of TEFLON® or a similar firm but smooth material. Optionally the structure can be configured so that the tubular and cylindrical elements are reversed.

An annular bushing 640, preferably comprised of a lightweight metal such as aluminum, comprises an opening 642 for a hand-retractable spring plunger 644, extending through nut or bushing 646, that engages one of several holes 648 in inner tubular member 604. Bushing 640 is attached to inner surface 632 of outer tubular member 606, and, when plunger 644 is retracted, outer tubular member 606 can be repositioned relative to inner tubular member 604. Plunger 644 is released so that plunger 644 engages a new hole 648.

Figure 16A:
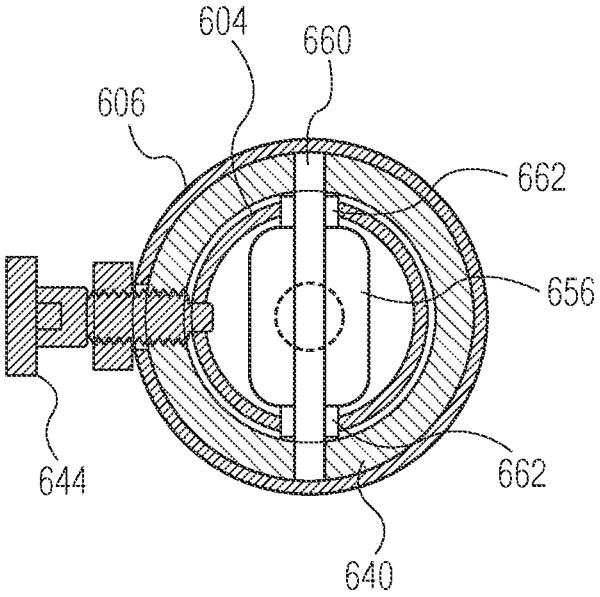
FIG. 16*a* is a cross-sectional view of a portion of FIG. 16.

A distal end 650 of cylindrical shaft 620 is attached by a connector or bolt 652 to an anti-rotation bar 656. As shown more clearly in the cross-sectional view of FIG. 16*a*, a dowel or pin 660 extends through anti-rotational bar 656 and engages nuts or fastenings 662, which are slidably movable within anti-rotational slots 668.

The distal portion of outer tubular member 606 comprises a grip mechanism 674 that includes a cylindrical grip base 676 and a grip lock knob 680. A grip handle 682 has a grip insert 684 that extends into a cylindrical chamber 686 within grip base 676 where a distal end 688 of grip insert 684 has at least two, preferably four, equally spaced cylindrical chambers 690 configured to receive a peg member 692. When grip knob lock 680 is rotated, for example, in a counter-clockwise direction, a spring 694 causes peg member 692 to retract, thus permitting the user or an operator to determine the position of grip handle 682 relative to the longitudinal axis of outer tubular member 606. When grip lock knob 680 is rotated in a clockwise position, peg member 692 engages a cylindrical opening 690 and grip handle 682 is locked in a desired position. One skilled in the art would appreciate that other mechanical configurations useful for releasably locking the grip handle in position could be used as well as what is described herein.

Figure 17:
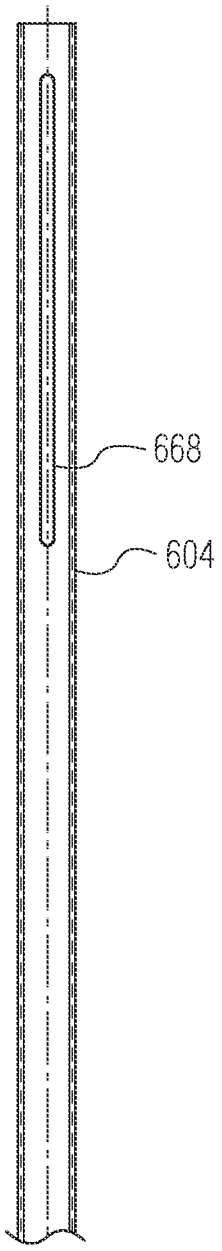
FIGS. 17 and 18 are each a partial view of a portion of the arm shown in FIG. 16.
Figure 18:
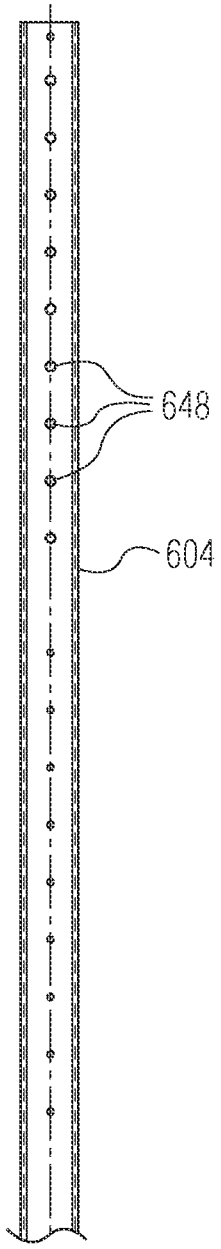

Partial lateral views of portions of inner tubular member 604 are shown in FIGS. 17 and 18. An anti-rotational slot 668 can be seen in FIG. 17, and holes 648 can be seen in FIG. 18. These two views are 90° from each other. Anti-rotational slot 668 will typically be from about 0.25 in. to about 0.50 in. wide and about 8 in. long. Holes 648 will typically be eight holes each from about 0.125 in. to about 0.25 in. in diameter and spaced about 1 in. to about 1.25 in. apart.

Figure 19:
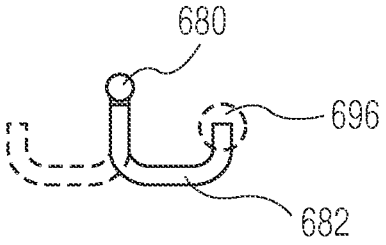
FIGS. 19 and 20 are each a partial view showing different orientations of grip handles according to the invention.
Figure 20:
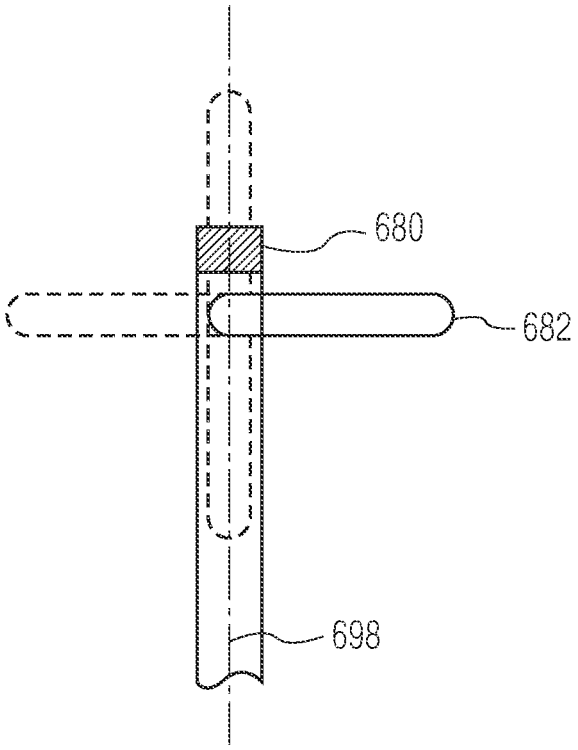

The grip mechanism shown in FIG. 16 can perhaps be better appreciated in the views of FIGS. 19 and 20. In FIG. 19, looking from above, grip handle 682 can be seen locked into two different positions. In the right-hand position grip handle 682 has an optional ball 696 that can be fitted over grip handle 682. Ball 696 could comprise any flexible rubberized material and could be from about 2 in. to 4 in. in diameter. Also, ball 696 could be another shape such as egg-shaped or polyhedric, that would be easy for a user with a disability to grasp or use.

FIG. 20 represents a front partial view where four different positions of grip handle 682 can be seen, relative to the longitudinal axis 698 of outer tubular member 606.

It should be appreciated that the exercise device of the invention described above has the advantage that it can provide an additional mode of exercise for a user. In addition to the exercise and resistance from, for example, moving the user's arms about the lower pivots, there is exercise and resistance in the longitudinal direction of the arms with handles as a result of the hydraulic cylinders positioned in the inner and outer tubular members.

There has thus been shown and described a novel exercising apparatus which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An exercising apparatus designed to fit around a seat to facilitate exercise by a user sitting in the seat, said apparatus comprising, in combination:

a frame configured to it around said seat;

an elongate arm pivotally coupled to said frame at a pivot point, said arm being movable about the pivot point in pivotal motion in the forward direction of a user sitting in the seat between a first position to a second position in response to a first force exerted by a user; and a first resistance device, coupled to said frame and to said arm, which provides a resistance force countering the first force during said pivotal motion of said arm by the user in at least one direction;

said elongate arm being longitudinal extendible and retractable in longitudinal motion between a retracted length and an extended length and having a second resistance device, coupled thereto, which provides a resistance force during said longitudinal motion of said arm in at least one longitudinal direction, countering a second force exerted by the user sitting in the seat;

wherein said arm comprises a first tube having a first width and a second tube having a second width which is less than said first width, and wherein said second tube is disposed, in part, inside said first tube, with one of said first and second tubes forming a first end and the other of said first and second tubes forming a second end of said arm, and wherein said first and second tubes are movable with respect to each other in the longitudinal direction;

wherein said arm is coupled to said frame at said pivot point at the first end and further comprises a user handle at said second end;

wherein said second resistance device disposed inside of said second tube;

wherein said second resistance device is a hydraulic piston and cylinder having two ends; and wherein said arm further comprises a bushing disposed between said first tube and said second tube and affixed to said first tube, and wherein one end of said second resistance device is coupled to said frame at said pivot point and an opposite end of said second resistance device is coupled to said bushing.

2. The exercising apparatus defined in claim 1, wherein said second resistance device provides a resistance force during said longitudinal motion in both longitudinal directions.

3. The exercising apparatus defined in claim 1, wherein said second tube has at least one longitudinal slot and wherein said arm further comprises a pin which extends through said bushing and said longitudinal slot.

4. The exercising apparatus defined in claim 1, further comprising an elongate user handle pivotally coupled to said arm at said second end, said arm having means for clamping said handle in a desired fixed position, wherein said handle pivots about a pivot axis which extends perpendicular to a longitudinal axis of said arm.

5. The exercising apparatus defined in claim 4, wherein said arm pivots about a substantially horizontal pivot axis with respect to said frame.

6. The exercising apparatus defined in claim 5, wherein said pivot axis of said handle is perpendicular to the pivot axis of said arm.

7. The exercising apparatus defined in claim 4, wherein said handle extends into a first opening at said second end of said arm and wherein said means for clamping said handle in a desired fixed position includes a lock knob at said second end which also extends into said first opening.

8. The exercising apparatus defined in claim 7, wherein said lock knob extends through a second opening in said arm which extends perpendicular to said first opening.

9. The exercising apparatus defined in claim 8, wherein said lock knob and said second opening are in screw threaded relationship.

10. The exercising apparatus defined in claim 8, wherein said second opening in said arm extends along a longitudinal axis of said arm and said lock knob is disposed on said arm at said second end.

11. The exercising apparatus defined in claim 7, wherein said elongate handle and said means for clamping said handle in position are operative to clamp said handle in at least two positions such that a longitudinal axis of said handle is perpendicular to said longitudinal axis of said arm.

12. The exercising apparatus defined in claim 7, wherein said elongate handle and said means for clamping said handle in position are operative to clamp said handle in at least four positions such that a longitudinal axis of said handle is either parallel or perpendicular to said longitudinal axis of said arm.

13. The exercising apparatus defined in claim 1, wherein said first resistance device provides a resistance force during said motion of said arm about said pivot point in both directions.

* * * * *